US007789727B2

(12) United States Patent
Chernick et al.

(10) Patent No.: US 7,789,727 B2
(45) Date of Patent: Sep. 7, 2010

(54) NOVELTY DEVICE HAVING ELASTOMERIC PROTRUSIONS WITH SOUND PRODUCING TERMINATIONS

(76) Inventors: Mark J. Chernick, 19180 144th Ave., NE., Woodinville, WA (US) 98072; Webb T. Nelson, 19180 144th Ave., NE., Woodinville, WA (US) 98072

( * ) Notice: Subject to any disclaimer, the term of this patent is extended or adjusted under 35 U.S.C. 154(b) by 0 days.

(21) Appl. No.: 12/271,947

(22) Filed: Nov. 17, 2008

(65) Prior Publication Data

US 2009/0068924 A1 Mar. 12, 2009

Related U.S. Application Data

(63) Continuation-in-part of application No. 11/825,829, filed on Jul. 10, 2007.

(51) Int. Cl.
*A63H 5/00* (2006.01)

(52) U.S. Cl. ..... 446/397; 446/85; 446/104; 446/107; 446/119; 446/120; 446/121; 446/122; 446/123; 446/124; 446/125; 446/126; 446/127; 446/128; 434/236; 434/247

(58) Field of Classification Search ..... 446/85, 446/104, 107, 119–128, 397; 434/236, 247
See application file for complete search history.

(56) References Cited

U.S. PATENT DOCUMENTS 2,226,806 A * 12/1940 Cohn ..... 84/404
2,318,460 A * 5/1943 Brief ..... 446/419
2,364,581 A * 12/1944 Zadek ..... 446/419
2,399,333 A * 4/1946 Desmond ..... 446/419
2,625,769 A * 1/1953 Hubbard ..... 446/96
3,464,151 A * 9/1969 Motley ..... 446/297
3,597,874 A * 8/1971 Ogsbury et al. ..... 446/104
3,611,621 A * 10/1971 Folson ..... 446/125
4,309,038 A * 1/1982 Spoon ..... 473/596
4,816,003 A * 3/1989 Yip et al. ..... 446/419
4,884,989 A * 12/1989 Wong ..... 446/168
4,991,841 A * 2/1991 Paranto ..... 473/609
5,020,438 A * 6/1991 Brown ..... 102/517
5,138,535 A * 8/1992 Aragon, Jr. ..... 362/102
5,180,171 A * 1/1993 Panzica et al. ..... 473/569
5,236,383 A * 8/1993 Connelly ..... 446/219
5,516,099 A * 5/1996 Strong ..... 473/614
5,690,446 A * 11/1997 Poissant et al. ..... 403/361
5,713,782 A * 2/1998 Jensen et al. ..... 446/419
5,785,529 A * 7/1998 Hearn et al. ..... 434/211
5,895,308 A * 4/1999 Spector ..... 446/397
5,938,499 A * 8/1999 Chen ..... 446/253
5,975,982 A * 11/1999 Spector ..... 446/397
6,024,660 A * 2/2000 Romanick ..... 473/596

(Continued)

*Primary Examiner*—Gene Kim
*Assistant Examiner*—Alexander R Niconovich
(74) *Attorney, Agent, or Firm*—LaMorte & Associates

(57) ABSTRACT

A novelty device and the associated method of fabricating component parts of the novelty device. The novelty device has at least one protrusion that is made from an elastomeric material. The protrusion has a distal end. A hole is disposed through the protrusion proximate its distal end. A secondary object is provided. The secondary object is made from a rigid material. The secondary object defines an interior space. Sounding elements are disposed within the interior space of at least some of the secondary objects. The sounding elements are free moving and produce noise within said secondary objects when said novelty device is manually shaken.

17 Claims, 4 Drawing Sheets

U.S. PATENT DOCUMENTS

| | | | | | |
|---|---|---|---|---|---|
| D431,848 | S | * | 10/2000 | Hubbard | D21/713 |
| 6,146,236 | A | * | 11/2000 | Kay | 446/419 |
| D439,378 | S | * | 3/2001 | Loomis | D30/160 |
| 6,216,640 | B1 | * | 4/2001 | Zelinger | 119/707 |
| 6,280,356 | B1 | * | 8/2001 | Sandeen | 473/614 |
| 6,346,664 | B1 | * | 2/2002 | Shuen | 84/402 |
| 6,514,161 | B1 | * | 2/2003 | Minniear | 473/428 |
| 6,568,982 | B2 | * | 5/2003 | Esterle | 446/122 |
| D500,901 | S | * | 1/2005 | Crane | D30/160 |
| 7,045,695 | B1 | * | 5/2006 | Cohen | 84/402 |
| D532,113 | S | * | 11/2006 | Huang | D24/214 |
| D535,341 | S | * | 1/2007 | Chernick et al. | D21/707 |
| D536,047 | S | * | 1/2007 | Chernick et al. | D21/707 |
| 7,165,869 | B2 | * | 1/2007 | Chernick et al. | 362/363 |
| D536,754 | S | * | 2/2007 | Chernick et al. | D21/707 |
| D537,131 | S | * | 2/2007 | Chernick et al. | D21/707 |
| D540,896 | S | * | 4/2007 | Chernick et al. | D21/707 |
| D561,277 | S | * | 2/2008 | Chernick et al. | D21/707 |
| 7,458,945 | B2 | * | 12/2008 | Zemont | 601/131 |
| 7,491,110 | B2 | * | 2/2009 | Chernick et al. | 446/268 |
| 2004/0146541 | A1 | * | 7/2004 | Chen | 424/405 |
| 2004/0161289 | A1 | * | 8/2004 | Silberman | 401/195 |
| 2005/0095949 | A1 | * | 5/2005 | Fernandez | 446/236 |
| 2005/0170742 | A1 | * | 8/2005 | Oestreicher | 446/227 |
| 2006/0073763 | A1 | * | 4/2006 | Tsun et al. | 446/486 |
| 2006/0084357 | A1 | * | 4/2006 | Rosen et al. | 446/91 |
| 2007/0135247 | A1 | * | 6/2007 | Huber | 473/614 |
| 2007/0172802 | A1 | * | 7/2007 | Adams et al. | 434/247 |
| 2008/0167683 | A1 | * | 7/2008 | Rodriguez | 606/235 |
| 2009/0017721 | A1 | * | 1/2009 | Chernick et al. | 446/486 |
| 2009/0130949 | A1 | * | 5/2009 | Chen et al. | 446/227 |
| 2009/0170645 | A1 | * | 7/2009 | Silvergate | 473/612 |

* cited by examiner

NOVELTY DEVICE HAVING ELASTOMERIC PROTRUSIONS WITH SOUND PRODUCING TERMINATIONS

RELATED APPLICATIONS

This application is a continuation-in-part of U.S. patent application Ser. No. 11/825,829, entitled Novelty Device Having Elastomeric Protrusions With Hard Plastic Terminations And Its Associated Method Of Construction, filed Jul. 10, 2007.

BACKGROUND OF THE INVENTION

1. Field of the Invention

In general, the present invention relates to novelty devices, toys, and noisemakers that are made in part, or in whole, of elastomeric material. More particularly, the present invention relates to novelty noisemakers, suck as cha-chas that and rattles that produce sound using loose elements in a confined structure.

2. Prior Art Description

The use of elastomeric gels have become commonplace in the toy and novelty device industries. Elastomeric gels are typically made from a polystyrene copolymer that is mixed with a plasticizing oil, such as mineral oil. Depending upon the amount of plasticizing oil used, the elasticity of the elastomeric gel can be controlled. Elastomeric gels compositions exist that enable the elastomeric gel to stretch one thousand percent (1000%) without damage. Furthermore, elastomeric gels made from polystyrene copolymers are highly resistant to tearing. Accordingly, products made from such elastomeric gels are both highly elastic and highly resistant to breakage. This makes such elastomeric gel materials ideal for use with toys.

Elastomeric gel is a material that can be extruded or injection molded. Toys and novelties that contain elastomeric gel, therefore, tend to be made entirely of the elastomeric gel. Due to the fact that elastomeric gels are highly elastic and are slick with mineral oil, it is difficult to adhere other material to elastomeric gel. In the manufacturing of toy and novelty devices, it will be understood that component parts are very commonly connected using adhesives. However, conventional adhesives tend to pull away from elastomeric gel material, especially if the elastomeric gel material is repeatedly stretched. It is especially difficult to attach a rigid object to an elongated strand of elastomeric gel. This is because an elongated strand of elastomeric gel thins significantly as it is stretched. Furthermore, significant tensile forces can be experienced in a strand of elastomeric gel that is stretched to its limit. The thinning of the elastomeric gel and the tensile forces both act to detach the elastomeric gel from whatever object it was originally attached.

In the industries of toy and novelty devices, objects that separate from the original device can become choking hazards. The mere chance that an object can separate from a toy may result in the need for a product recall. A need therefore exists for an improved manner of attaching elastomer gel material to secondary objects in a more reliable manner.

SUMMARY OF THE INVENTION

The present invention is a novelty noisemaker device having a body capable of being shaken by manual manipulation. A plurality of protrusions extend from the body. Each of the protrusions has a proximal end that attaches to the body and a distal end that extends away from the body. Each of the protrusions is fabricated from an elastomeric material that enables it to flex and undulate as the novelty device is shaken.

A plurality of rigid secondary objects are provided that are affixed to the distal ends of the various protrusions. Consequently, the protrusions interconnect the plurality of rigid secondary objects to body. The protrusions are long enough so that they enable the rigid secondary objects to randomly collide and make noise when the body is manually shaken. Furthermore, a plurality of sounding elements are provided in at least some of the secondary objects. The sounding elements are free moving and produce noise within the secondary objects when the novelty device is manually shaken.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention novelty device can have many configurations, in its simplest form, it can be formed as a ball. Accordingly, the shown exemplary embodiment of the present invention is presented as a ball in order to provide the best and simplest mode contemplated for the invention. However, it should be understood that the novelty device can function as described below if configured into shapes more complex than a ball.

Figure 1:
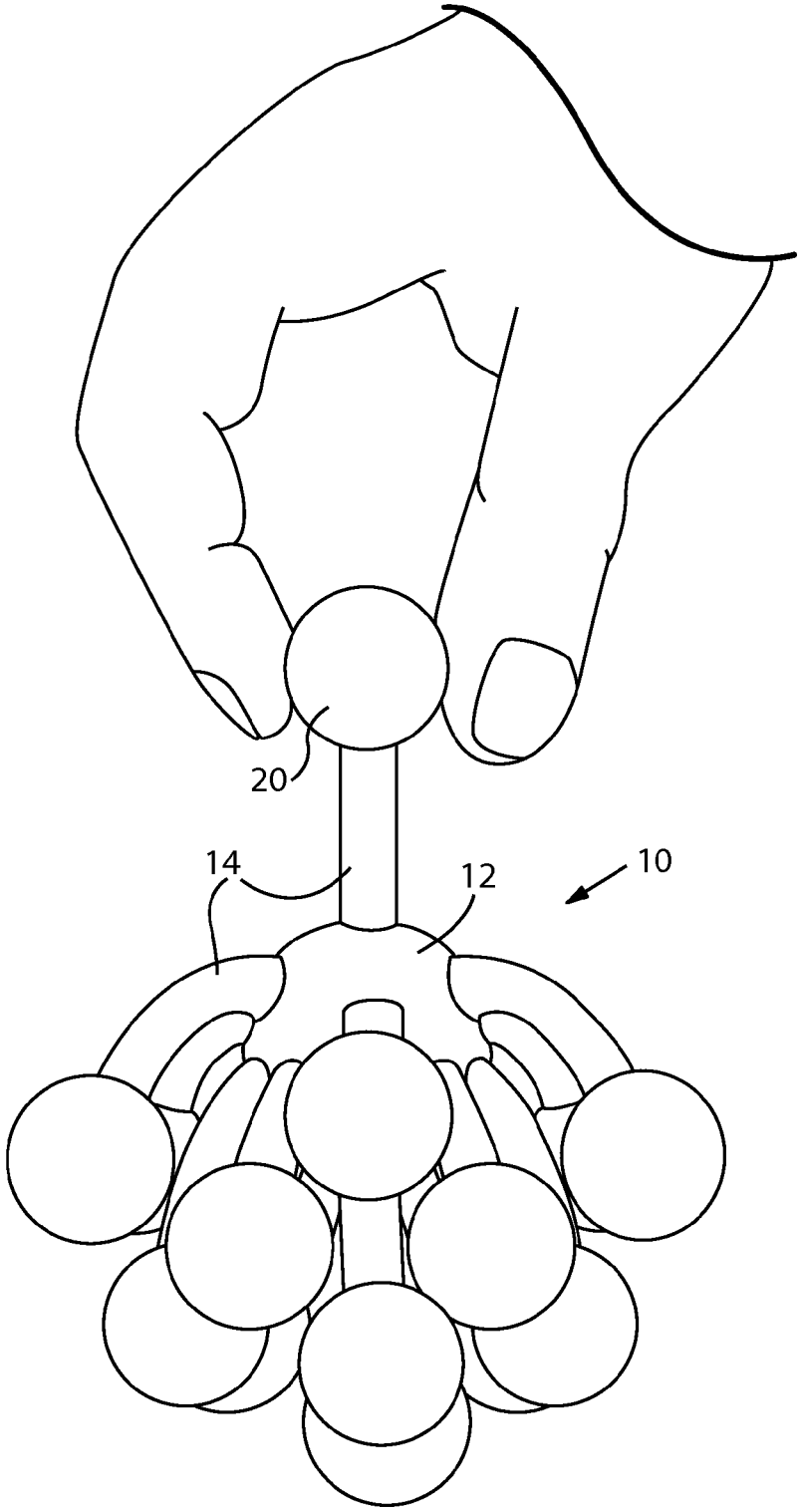
FIG. 1 is a perspective view of an exemplary embodiment of the present invention novelty device.

Referring to FIG. 1, the present invention novelty device 10 is embodied as a toy ball. The novelty device 10 includes a central hub 12. The central hub 12 can be either solid or hollow. In the shown embodiment, the central hub 12 is spherical in shape. However, such a shape is merely exemplary and it should be understood that other shapes can be used.

A plurality of protrusions 14 radially extend from the exterior of the central hub 12. The number, length, and thickness of the protrusions 14 can be varied as a matter of design choice. Both the central hub 12 and the plurality of protrusions 14 are made from a polystyrene-based elastomeric gel. It will therefore be understood that the central hub 12 and the plurality of protrusions 14 can be molded as a single-piece unit using standard injection molding techniques.

Each of the plurality of protrusions 14 has a distal end that terminates with a secondary object 20. The secondary object 20 is made of a rigid material, such as hard plastic. It will therefore be understood that the secondary objects 20 do not share the same elastic properties as the elastomeric gel of the central hub 12 and protrusions 14.

In the shown embodiment, the secondary objects 20 are small balls. The use of small balls is merely exemplary and it should be understood that secondary objects of many other shapes can also be used.

Figure 2:
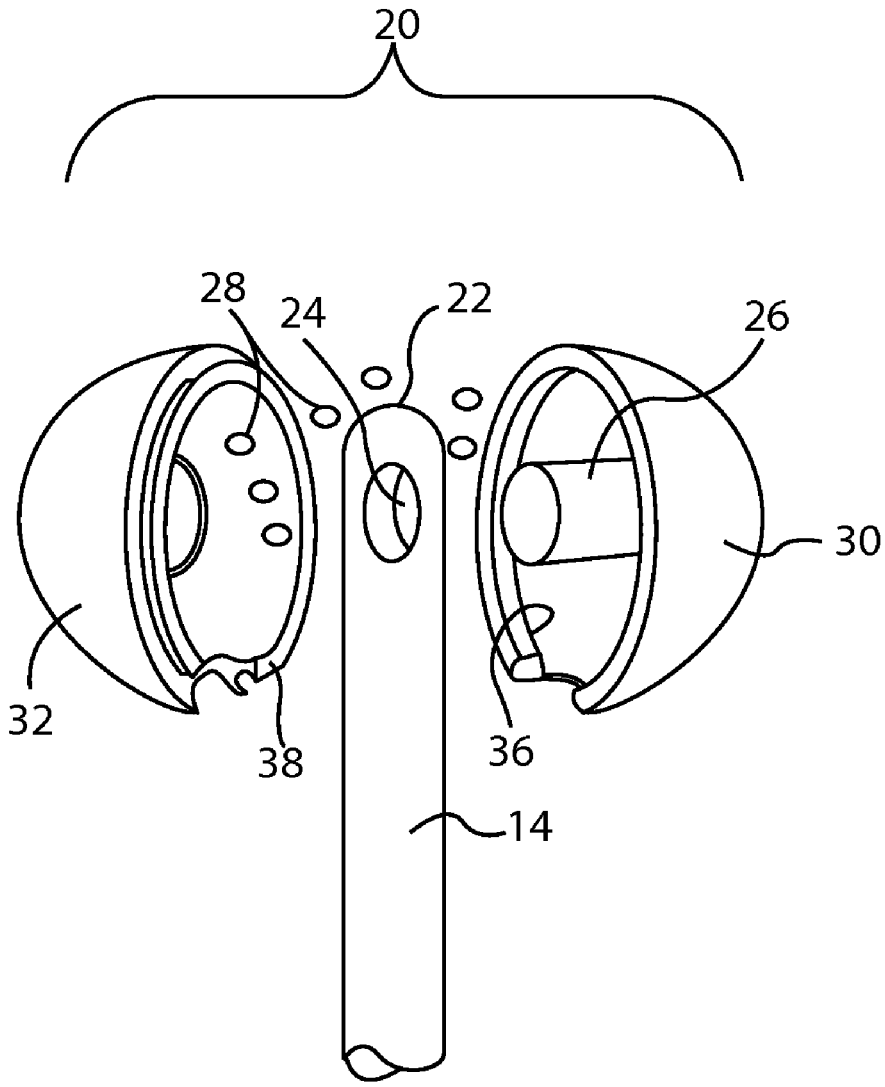
FIG. 2 is a perspective exploded view of an exemplary embodiment of a secondary object at the end of an elastomeric protrusion.
Figure 3:
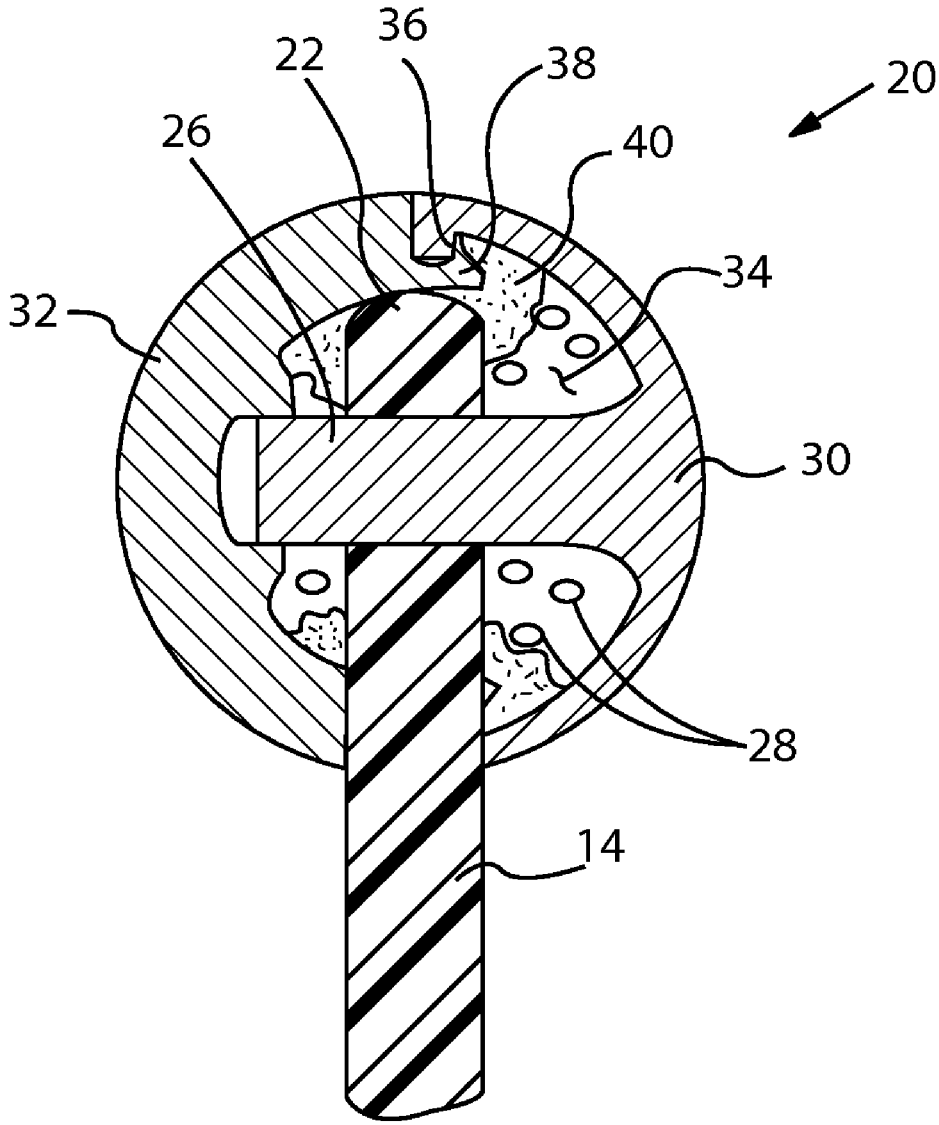
FIG. 3 is a cross-sectional view of an exemplary embodiment of a secondary object at the end of an elastomeric gel protrusion.

Referring to FIG. 2 in conjunction with FIG. 3, the attachment means used to connect the secondary objects 20 to the distal ends 22 of the protrusions 14 can be understood. A hole 24 is formed through each protrusion 14 near its distal end 22. The hole 24 can be created during the molding of the protrusion 14 or can be punched through the protrusion 14 in a secondary operation. The secondary object 20 is a two piece assembly that snaps together. A post 26 extends from a first piece 30 of the secondary object 20. The post 26 passes through the hole 24 in the protrusion 14 as the first piece 30 and the second piece 32 of the secondary object 20 are assembled. The result is a mechanical interconnection that prevents the distal end 22 of the protrusion 14 from being pulled out of the secondary object 20.

In the shown embodiment, each secondary object 20 has a first piece 30 and a second piece 32 that are shaped as hemispherical halves. When connected, the first and second pieces 30, 32 create a secondary object 20 that is shaped as a ball. When the two pieces 30, 32 are interconnected, the two pieces 30, 32 define an open interior space 34. The open interior space 34 is sized to enable the distal end 22 of a protrusion 14 to pass into the interior of the secondary object 20.

The first and second pieces 30, 32 of the secondary object 20 preferably snap together. Accordingly, one piece of the secondary object 20 contains a locking lip 36. The opposite piece of the secondary object 20 contains a pawl structure 38 that engages the locking lip 36 when the secondary object 20 is fully assembly. It will therefore be understood that once the two pieces 30, 32 of the secondary object 20 are assembled together, they cannot be separated in a non-destructive manner.

A dab of adhesive 40 is preferably placed in between the first and second pieces 30, 32 of the secondary object 20, prior to the assembly of the secondary object 20. The adhesive helps to prevent the first and second pieces 30, 32 of the secondary object 20 from separating, even if the secondary object 20 were to become damaged.

In the shown embodiment, a single hole 24 is formed in the protrusion 14. Similarly, a single post 26 is shown in the secondary object 20 that passes through the single hole 24. The use of a single post 26 and a single hole 24 is exemplary. For larger protrusions and larger secondary objects, it should be understood that more than one hole can be formed in the secondary object. Likewise, a corresponding number of posts can be used to engage the holes.

A plurality of small hard sounding elements 28, such as beads, seeds or the like are placed into the interior 34 of at least some of the secondary objects 20. The sounding elements 28 move around freely within the secondary object 20. Accordingly, as a secondary object 20 moves, the sounding elements 28 strike the interior of the secondary object 20 and make noise in the same manner as a rattle or cha-cha.

Figure 4:
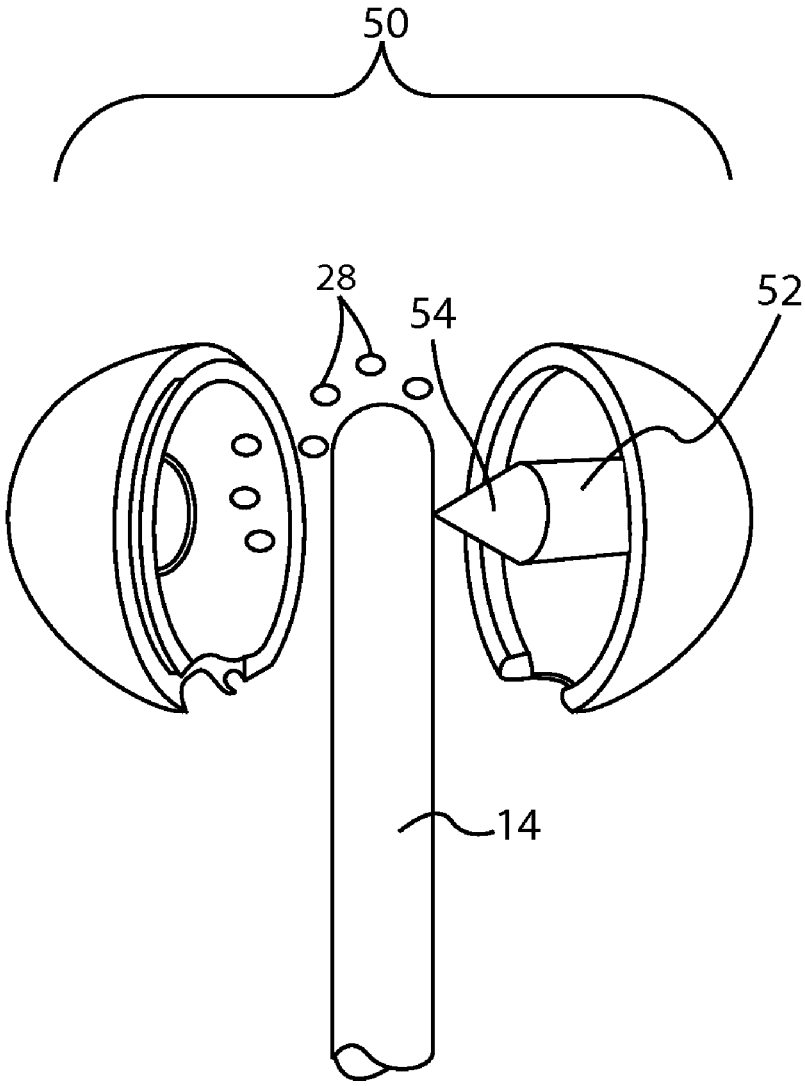
FIG. 4 is a perspective exploded view of an alternate embodiment of a secondary object at the end of an elastomeric protrusion.

In the embodiment of FIG. 2 and FIG. 3, the hole 24 is preformed in the protrusion 14. This need not be the case. Referring to FIG. 4, an alternate embodiment of a secondary object 50 is shown. The secondary embodiment 50 being illustrated is the same as that previously described, but with one exception. In the embodiment of FIG. 4, the post 52 has a sharpened point 54. When the secondary object 50 is assembled, the sharpened point 54 of the post 52 drives through the material of the protrusion 14, thereby making its own hole in the protrusion 14 and mechanically connecting the secondary object 50 to the protrusion 14. Sounding elements 28 are provided within the secondary object 20 to make noise.

It will be understood that the embodiment of the present invention novelty device that is shown is merely exemplary and that a person skilled in the art can make many variations to the embodiment without departing from the intended scope of the invention. For instance, it will be understood that the shown design of a novelty ball is exemplary. The present invention can be adapted for use with any toy having elastomeric gel protrusions, such as toys with elastomeric hair strands. Furthermore, the secondary objects can be formed in any shape, and need not be balls. The exterior shape of the secondary object is a matter of design choice. What is important is that the secondary objects have pieces that close together over the distal end of an elastomeric gel protrusion. All such modifications, variations, and alternate embodiments are intended to be included within the scope of the present invention as defined by the claims.

What is claimed is:

1. A novelty device, comprising:

a hub;

a plurality of flexible protrusions extending from said hub, each of said flexible protrusions being made of an elastomeric gel and terminating at a distal end;

a secondary object coupled to said distal end of each of said flexible protrusions, wherein each said secondary object defines an interior space in which is disposed a post, and wherein one of said flexible projections extends into interior space, wherein said post extends through said flexible projection proximate said distal end, therein binding said secondary object to said flexible protrusion; and a plurality of sounding elements free moving within present within at least some of said secondary objects.

2. The device according to claim 1, wherein said hub and said plurality of flexible protrusions are injection molded from a common elastomeric material.

3. The device according to claim 2, wherein said common elastomeric material is a styrene-based elastomeric gel.

4. The device according to claim 1, wherein said secondary object includes a first piece and a second piece that interconnect to form said secondary object.

5. The device according to claim 3, wherein said first piece and said second piece connect together with a snap fit.

6. The device according to claim 3, further including adhesive that binds said first piece to said second piece.

7. A novelty device, comprising:

a central hub;

a plurality of protrusions radially extending from said central hub, each of said protrusions having a proximal end that attaches to said hub and a distal end that extends away from said central hub, wherein each of said protrusions is fabricated from an elastomeric gel;

a plurality of rigid secondary objects, wherein a post is disposed within each of said rigid secondary objects, wherein said post extends through one of said protrusions, therein connecting said plurality of rigid object to said protrusions, wherein a rigid secondary object is affixed to said distal end of each of said protrusions so that said protrusions interconnect said plurality of rigid secondary objects to said central hub; and a plurality of sounding elements in at least some of said secondary objects, wherein said sounding element are free moving and produce noise when said novelty device is dynamically manipulated.

8. The device according to claim 7, wherein said central hub is made of elastomeric gel and is integrally molded with said plurality of protrusions.

9. The device according to claim 7, wherein said central hub is spherical.

10. The device according to claim 7, wherein a hole is disposed through each of said protrusions proximate each said distal end.

11. The device according to claim 10, wherein each of said secondary objects defines an interior, wherein each said distal end of each of said protrusions extends into a corresponding interior of each of said secondary objects.

12. The device according to claim 7, wherein each of said secondary objects includes a first piece and a second piece that interconnect.

13. The device according to claim 12, wherein said first piece and said second piece connect together with a snap fit.

14. The device according to claim 12, further including adhesive that binds said first piece to said second piece.

15. A novelty noisemaker device, comprising a body capable of being shaken by manual manipulation;

a plurality of protrusions radially extending from said body, each of said protrusions having a proximal end that attaches to said body and a distal end that extends away from said central body, wherein each of said protrusions is fabricated from an elastomeric material;

a plurality of rigid secondary objects, wherein each of said secondary objects contains a post, and wherein said post of each of said rigid secondary objects extends through one of said protrusions proximate its distal end, therein affixing said secondary objects to said protrusions, whereby said protrusions interconnect said plurality of rigid secondary objects to said body, wherein said rigid secondary objects randomly collide and make noise when said body is manually shaken; and a plurality of sounding elements in at least some of said secondary objects, wherein said sounding element are free moving and produce noise within said secondary objects when said novelty device is manually shaken.

16. The device according to claim 15, wherein said body is spherical and said protrusions radially extends from said body in a symmetrical pattern.

17. The device according to claim 16 wherein each of said protrusions has a uniform length.

* * * * *